US006617954B2

(12) United States Patent
Firestine

(10) Patent No.: US 6,617,954 B2
(45) Date of Patent: Sep. 9, 2003

(54) TAMPER RESISTANT TEMPERATURE CONTROLLER FOR A GAS-FIRED HEATING DEVICE

(75) Inventor: David Michael Firestine, Johnson City, TN (US)

(73) Assignee: Robertshaw Controls Company, Richmond, VA (US)

( * ) Notice: Subject to any disclaimer, the term of this patent is extended or adjusted under 35 U.S.C. 154(b) by 0 days.

(21) Appl. No.: 09/797,794

(22) Filed: Mar. 2, 2001

(65) Prior Publication Data

US 2002/0121305 A1 Sep. 5, 2002

(51) Int. Cl.[7] ..... G05G 5/06; H01H 71/00

(52) U.S. Cl. ..... 337/320; 251/89; 70/174; 74/527; 337/2

(58) Field of Search ..... 337/320, 2, 12; 251/89; 70/174; 74/527

(56) References Cited

U.S. PATENT DOCUMENTS

| | | | | |
|---|---|---|---|---|
| 1,068,961 A | | 7/1913 | Baker | |
| 1,104,918 A | * | 7/1914 | Mouat | 251/285 |
| 1,473,774 A | | 11/1923 | Leech, Jr. | |
| 1,651,038 A | | 11/1927 | Muller | |
| 1,673,454 A | | 6/1928 | Hochstein | |
| 1,689,236 A | | 10/1928 | Fraser, Jr. | |
| 2,253,162 A | | 8/1941 | Ayers | |
| 2,953,937 A | | 9/1960 | Jackson et al. | |
| 3,203,265 A | | 8/1965 | Flegel | |
| 3,537,473 A | | 11/1970 | DeZurik, Jr. | |
| 3,597,138 A | | 8/1971 | Ray | |
| 3,810,064 A | | 5/1974 | Flegel | |
| 4,235,323 A | | 11/1980 | Dykzeul | |
| 4,588,851 A | | 5/1986 | Turner | |
| 4,895,043 A | * | 1/1990 | Lee | 74/527 |
| 5,003,803 A | | 4/1991 | Richards | |
| 5,363,720 A | | 11/1994 | Sanchez | |
| 5,427,135 A | | 6/1995 | Kieper | |
| 5,427,140 A | | 6/1995 | Bosanquet | |
| 5,513,831 A | | 5/1996 | Seward | |
| 5,590,682 A | | 1/1997 | Fischer | |
| 5,647,389 A | * | 7/1997 | Holloway | 137/15.18 |
| 5,950,982 A | | 9/1999 | Williams | |
| 6,012,445 A | | 1/2000 | Santelli, Jr. | |

* cited by examiner

*Primary Examiner*—Jayprakash N. Gandhi
(74) *Attorney, Agent, or Firm*—Blackwell Sanders Peper Martin LLP

(57) ABSTRACT

A device for preventing the inadvertent rotation of a temperature selection dial associated with the temperature controller of a water heater. The device includes a spring-loaded prong that extends across the face of a rotatable dial so as to prevent rotation of thereof. The force required to pry the prong off of the dial is selected to be greater than what a small child is typically capable of exerting.

17 Claims, 1 Drawing Sheet

TAMPER RESISTANT TEMPERATURE CONTROLLER FOR A GAS-FIRED HEATING DEVICE

BACKGROUND OF THE INVENTION

The present invention is generally directed to a safety device and more particularly pertains to a device for preventing the inadvertent adjustment of a water heater's set temperature.

The temperature at which water is maintained within a water heater is typically adjusted by a rotatable dial. In the case of a gas-fired water heater, such dial is associated with a controller valve that directs the flow of gas to a burner whenever the actual water temperature falls below the set temperature. Excessive water temperature is a hazard in that it may cause scalding at any of the various faucets or appliances serviced by the water heater. Accidental or inadvertent adjustment of such dial can cause water to issue at unexpectedly high temperatures. On the other hand, while a temperature setting that had inadvertently been dialed down may not be hazardous, it can nonetheless constitute a nuisance.

The temperature set dial on gas controller valves is typically easily accessible and easily rotated. If the water heater is located in a readily accessible location, such as in an unsegregated section of a garage or an unlocked closet, the dial can easily be tampered with by children playing in the area or by individuals bent on mischief.

Properly securing a water heater from this type of tampering typically results in additional cost and/or inconvenience as to its use. Locking the water heater into an enclosure requires either keys to be kept or a combination to be remembered. An enclosure may also hamper the installation, replacement or servicing of the water heater.

Devices have previously been developed that are associated directly with a control knob or valve to prevent tampering but again, substantial additional cost of manufacture or inconvenience as to use is typically involved. Such devices either lock the knob or valve into place to physically prevent it from being rotated or serve to decouple the knob or valve from an internal actuation mechanism. In addition to the extra cost involved in the manufacture, such devices are often difficult to retrofit to existing installations.

A device is therefore needed with which the inadvertent adjustment of a temperature control dial can be prevented or deterred, that can be manufactured and installed with minimal cost, that can be readily retrofitted to existing controllers and that is easy for an adult to manipulate.

SUMMARY OF THE INVENTION

The present invention provides a simple device that prevents inadvertent adjustment of a water heater's set temperature. Although the device prevents tampering by small children, it is easily defeated by an adult user. The device additionally makes it difficult for anyone to tamper with the controller's temperature calibration. Moreover, the device is inexpensive and is easily retrofitted to existing controller devices.

The device includes a spring-loaded prong that is attached to the controller housing so as to extend across the face of the temperature set dial. The prong is configured to apply a force against the face of the dial and to engage outwardly extending nubs formed thereon. The interaction of the prong with a nub positively prevents rotation of the dial. In order to make an adjustment to the temperature setting, the prong must be pulled or pried off of the face of the dial to disengage the nub, wherein the force necessary to do so exceeds the capability of most small children. An adult on the other hand would be capable of exerting enough force, thereby releasing the dial for rotation to the desired setting. An aperture formed in the prong allows an appropriate prying tool to optionally be inserted to allow the force of the prong to be more easily defeated. The position of the prong additionally serves to prevent the dial from being pulled off of its shaft to thereby preclude access to the temperature calibration screw located below the dial.

The prong is easily retrofitted to an existing controller by removal of a single fastener, insertion of the base of the prong and replacement of the fastener. Optionally, the prong may be configured to be clipped onto the controller housing. A dial devoid of outwardly extending nubs formed on its face would additionally have to be replaced which simply requires the original dial to be pulled of its shaft and the replacement to be slipped there onto.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The present invention provides a safety device for preventing the inadvertent adjustment of a temperature dial associated with a water heater. The device is fitted to the gas controller for a water heater and serves to prevent the rotation of the adjustment dial. Overcoming the device requires either significant strength that a small child is not capable of or the use of a specially configured tool.

Figure 1:
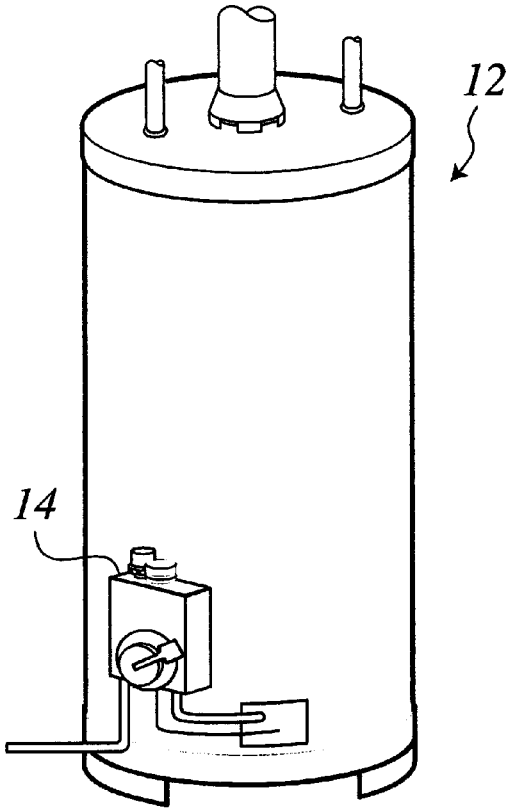
FIG. 1 is a perspective view of a water heater fitted with the safety device of the present invention.

FIG. 1 is a perspective view of a water heater 12 showing the location of the gas controller valve 14 fitted thereto. The gas controller valve regulates the flow of gas to a burner positioned below the water tank so as to maintain the water contained therein at a preselected temperature. The controller valve is located on the side of the water heater as shown in order to provide easy access thereto as is required when adjusting the set temperature or lighting the pilot flame. The controller valve that is fitted to the water heater includes the anti-tamper mechanism of the present invention.

Figure 2:
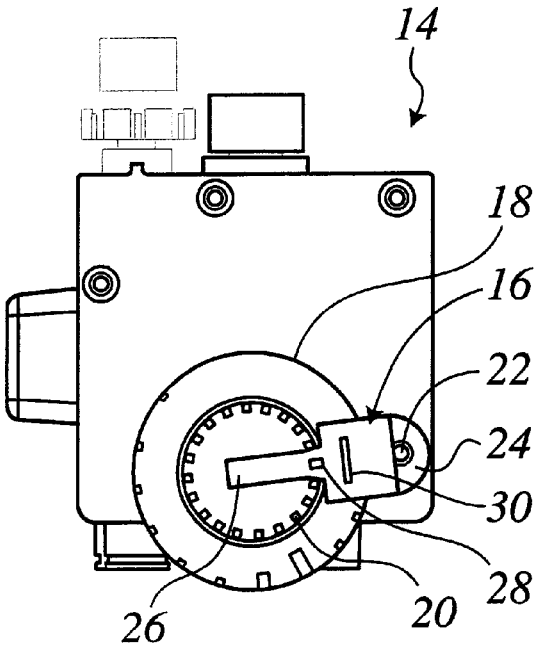
FIG. 2 is an enlarged frontal view of the gas controller with the anti-tamper device of the present invention fitted thereto.

FIG. 2 is an enlarged frontal view of the gas controller valve 14 of the water heater shown in FIG. 1 and more clearly illustrates the anti-tamper mechanism including a prong 16 and specially contoured dial 18. The dial allows the set temperature to be selected by rotation in one direction to increase the set temperature and rotation in the opposite direction to decrease the set temperature. The dial includes a plurality of raised nubs 20 that extend outwardly from the face of the dial. In the embodiment shown, twenty nubs are arranged in a circular pattern, each nub having a square configuration and extending above the face of the dial by about 0.040 inches. Not visible in the illustration is a temperature calibration screw located underneath the dial which is accessible only by removing the dial by pulling it off of its shaft. The prong 16 is attached to the controller valve housing via a fastener 22 that extends through its base 24. A fastener having a TORX head or an Allen head discourages disassembly by a laymen without serving as an impediment to a technician equipped with the proper tools. Alternatively, the prong may be riveted to the controller valve housing for a more permanent installation or configured to be clipped thereto to enable very quick and simple retrofitment. The distal end 26 of the prong extends across the face of the dial and is firmly biased there against. An aperture 28 formed in the prong is positioned and dimensioned to receive a nub 20 there through. A slot 30 formed in the prong is dimensioned to allow the insertion of a flat head screw driver or similar pry tool.

Figure 3:
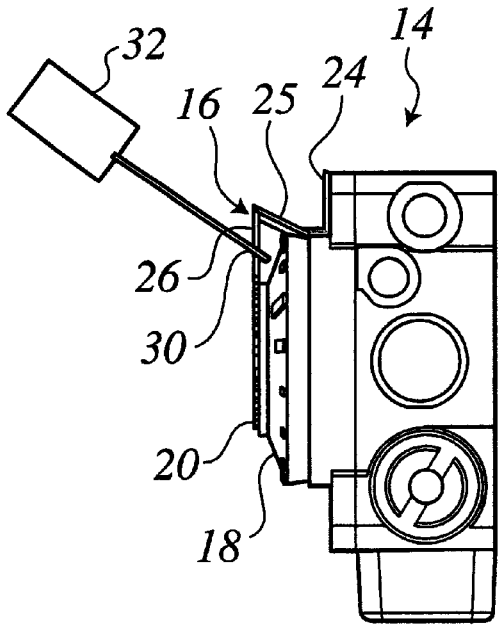
FIG. 3 is an enlarged bottom view of the gas controller with the anti-tamper device of the present invention fitted thereto.

FIG. 3 is an enlarged bottom view of the controller 14 fitted with the anti-tamper mechanism. The nubs 20 are visible extending outwardly from the dial 18 while the structure of prong 16 is clearly visible, including its base section 24 by which it is attached to the controller housing, an intermediate section 25 that extends outwardly from the base and distal section 26 that extends across the face of the dial. The figure additionally shows a pry tool 32 that has been inserted in slot 30 to allow the distal section to be more easily pried off of the face of the dial to disengage the dial's nubs.

The dial 18 is preferably formed of plastic and is attached to a rotatable shaft by an interference fit whereby rotation of the dial results in rotation of the shaft. By exerting a sufficiently high pulling force, the dial can be readily detached from the shaft. The prong 16 is preferably formed of spring steel so that a sufficiently high force can be applied to the face of the dial and so that its shape is retained even after undergoing repeated flexure cycles to release the dial. The prong is preferably configured and dimensioned to exert about a 15 lb force against the face of the dial.

In use, the force of the prong 16 against the dial 18 not only increases friction between the dial and the controller valve housing to render the dial harder to rotate, but the cooperation of an aligned nub 20 with the aperture 28 formed in the prong positively prevents rotation. The presence of the prong across the face of the dial additionally prevents the dial from being removed or from accidently becoming dislodged and thereby prevents tampering with the temperature calibration screw located there below.

In order to reset the set temperature, the prong 16 must be pried off of the face of the dial 18. While the 15 lbs of force exerted by the prong against the dial would prevent a child from successfully disengaging the prong from a nub 20, an adult should find such force reasonably easy to overcome by for example inserting a finger underneath the prong and pulling. Once free of the nub, the dial is easily rotated to the desired position. If such force proves to be too high, a flat head screw driver 32 or similar device is easily inserted into slot 30 to allow the prong to be pried off of the face of the dial.

In order to retrofit the anti-tamper mechanism to an existing controller valve, the original dial must first be removed and replaced with a dial 18 having the appropriate nubs 20 formed thereon. This is accomplished by simply pulling the original dial off of the controller and pushing the replacement dial onto the shaft. The prong 16 must then be fitted. A clip-on configuration allows attachment to be accomplished without the use of any tools. A prong configuration as is illustrated in the figures requires the removal of the fastener 22 with the appropriate tool and insertion of the base 24 of the prong. Subsequent replacement and tightening of the fastener completes the retrofitment.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A set temperature adjustment device associated with a gas controller for a gas-fired heating device, comprising:

a rotatable dial having raised nubs formed on its face; and a spring-loaded prong is attached to a gas controller for a gas-fired heating device and for releasably applying pressure against said face of said dial so as to inhibit rotation thereof and to prevent removal thereof.

2. The set temperature adjustment device of claim 1, wherein said prong is formed for engaging one of said nubs so as to positively prevent rotation of said dial.

3. The set temperature adjustment device of claim 2, wherein said prong has an aperture formed therein configured to receive one of said nubs therein.

4. The set temperature adjustment device of claim 1, wherein said prong comprises a base section is attached to said gas controller for a gas-fired heating device and a distal section for extending across said dial and wherein said prong is wholly formed of spring steel.

5. The set temperature adjustment device of claim 1, further comprising a removable pry tool for engaging said prong to facilitate relieving said pressure against said dial.

6. The set temperature adjustment device of claim 1, wherein said prong has a pry tool receiving aperture formed therein to facilitate use of a pry tool for relieving said pressure against said dial.

7. The set temperature adjustment device of claim 1, wherein said pry tool receiving aperture is shaped to receive a flat head screw driver.

8. The set temperature adjustment device of claim 1, wherein said prong is configured so as to allow it to be manually grasped and forced off of said dial.

9. The set temperature adjustment device of claim 1, wherein said prong is attached to said gas controller for a gas-fired heating device by a fastener that additionally serves to join components of said gas controller.

10. The set temperature adjustment device of claim 1, wherein said prong is attached to said gas controller by a rivet.

11. A safety device for preventing inadvertent rotation of a rotatable dial with which a set temperature in a gas-fired heating device is selected, comprising a rotatable dial positioned on a gas controller valve housing for a gas-fired hearing device and further including a prong element that is attached to said gas controller valve housing for a gas-fired heating device and said prong element extends across a face of said rotatable dial and is biased against said rotatable dial.

12. The safety device of claim 11, wherein said device is configured for use with a water heater.

13. The safety device of claim 11, wherein said dial has nubs formed thereon that extend outwardly from its face and wherein said prong element is configured to engage one of said nubs when aligned therewith to positively prevent inadvertent rotation of said dial.

14. The safety device of claim 11, wherein said prong element has a pry tool receiving aperture formed therein for facilitating use of a pry tool to facilitate relieving of said bias against said dial.

15. The safety device of claim 14, wherein said pry tool receiving aperture is formed to receive a flat head screw driver.

16. The safety device of claim 11, wherein said prong element is formed of spring steel.

17. The safety device of claim 11, wherein said gas controller valve housing for a gas fired heating device has a temperature compensation mechanism positioned below said rotatable dial and said prong is configured to preclude removal of said rotatable dial so as to prevent adjustment of said temperature calibration mechanism without removal of said prong element from said gas controller valve housing for a gas-fired heating device.

* * * * *

UNITED STATES PATENT AND TRADEMARK OFFICE

CERTIFICATE OF CORRECTION

PATENT NO. : 6,617,954 B2 
DATED : September 9, 2003
INVENTOR(S) : David Michael Firestine It is certified that error appears in the above-identified patent and that said Letters Patent is hereby corrected as shown below:

Title page,
Item [54], after the word "CONTROLLER", delete "FOR A GAS-FIRED HEATING DEVICE";

Title page,
Item [*] Notice, delete "0 days" and replace with -- 126 days --;

Column 4,
Line 59, delete "hearing" and replace with -- heating --.

Signed and Sealed this

Sixteenth Day of December, 2003

JAMES E. ROGAN
*Director of the United States Patent and Trademark Office*